US005604012A

United States Patent [19]

Okamoto et al.

[11] Patent Number: 5,604,012

[45] Date of Patent: Feb. 18, 1997

[54] HOLLOW FIBER FABRIC AND PROCESS FOR PRODUCING THE SAME

[75] Inventors: Ichiro Okamoto; Tsuguo Fujiwara, both of Matsuyama; Hiroya Murase; Shigenobu Kobayashi, both of Ibaraki, all of Japan

[73] Assignee: Teijin Limited, Osaka, Japan

[21] Appl. No.: 505,356

[22] PCT Filed: Jan. 9, 1995

[86] PCT No.: PCT/JP95/00009

§ 371 Date: Aug. 30, 1995

§ 102(e) Date: Aug. 30, 1995

[87] PCT Pub. No.: WO95/19461

PCT Pub. Date: Jul. 20, 1995

[30] Foreign Application Priority Data

| | | | |
|---|---|---|---|
| Jan. 13, 1994 | [JP] | Japan | 6-002099 |
| Apr. 18, 1994 | [JP] | Japan | 6-078604 |
| Jun. 30, 1994 | [JP] | Japan | 6-149436 |

[51] Int. Cl.[6] ..... B32B 3/10

[52] U.S. Cl. ..... 428/136; 210/500.23; 210/924; 264/154; 264/162; 264/177.14; 264/171.26; 428/398; 428/400; 442/338

[58] Field of Search ..... 428/225, 229, 428/253, 398, 136, 400; 210/500.23, 924, 500.36; 264/154, 162, 173, 177.14

[56] References Cited

U.S. PATENT DOCUMENTS

| | | | |
|---|---|---|---|
| 4,055,696 | 10/1977 | Kamada et al. | 428/398 |
| 4,336,138 | 6/1982 | Taniyama et al. | 210/321.4 |
| 4,336,307 | 6/1982 | Shiozaki et al. | 428/398 |
| 4,357,390 | 11/1982 | Ozaki et al. | 428/398 |
| 4,619,724 | 10/1986 | Chatow | 156/72 |
| 4,666,469 | 5/1987 | Krueger et al. | 55/16 |
| 4,678,573 | 7/1987 | Otstot et al. | 210/321.1 |
| 4,810,384 | 3/1989 | Fabre | 210/500.23 |
| 4,865,786 | 9/1989 | Shibukawa et al. | 264/51 |
| 5,026,479 | 6/1991 | Bikson et al. | 210/321.8 |
| 5,134,031 | 7/1992 | Kagechi et al. | 428/373 |
| 5,374,448 | 12/1994 | Von Bonin | 427/2.31 |
| 5,480,712 | 1/1996 | Takahashi et al. | 428/316.6 |

FOREIGN PATENT DOCUMENTS

| | | |
|---|---|---|
| 154712 | 11/1981 | Japan . |
| 169817 | 12/1981 | Japan . |
| 044160 | 2/1993 | Japan . |

OTHER PUBLICATIONS

Man–Made Fibers –Science and Technology, vol. 1 pp. 226 & 327.

*Primary Examiner*—James J. Bell
*Attorney, Agent, or Firm*—Burgess, Ryan and Wayne

[57] ABSTRACT

A hollow fiber fabric comprising hollow fibers having a high hollowness ratio of at least 20% and composed of a polymer of a single composition, and the hollow fibers having slits as traces of a removed polymer and the slits being formed in the longitudinal direction of the fibers in such a state that the slits communicate to hollow portions. The fabric is produced by treating a fabric comprising hollow fibers having a high hollowness ratio of at least 20% and composed of a polymer of a single composition with a solvent or solution which dissolves the polymer, to partially dissolve the polymer at low orientation and/or deformation strain concentrated portions, to form slits as traces of a removed polymer in such a state that the slits communicate to hollow portions, along the longitudinal direction of the hollow fibers.

9 Claims, 5 Drawing Sheets

HOLLOW FIBER FABRIC AND PROCESS FOR PRODUCING THE SAME

TECHNICAL FIELD

The present invention relates to a hollow fiber fabric and a process for producing the same. The present invention also relates to a fabric having a novel structure wherein an agent, which gives a functionality to the fibers, is introduced in the hollow portions of the hollow fibers which constitute the fabric.

BACKGROUND ART

Many proposals have been made regarding hollow fibers having holes which communicate from the surface of the fibers to hollow portions thereof. For instance, a water absorptive fiber is disclosed in Japanese Examined Patent Publication No. 61-60188 in which polyester hollow fibers blended with an organic sulfonic acid metal salt are subjected to an alkali treatment to dissolve off the organic sulfonic acid metal salt and to form, as traces of the removed salt, micropores having a diameter of 5 μm and communicating to hollow portions.

However, there were problems that since the communicating pores obtained by this method are extremely fine, they scarcely affect the hand feeling of the hollow fibers and that there is a limit in the improvement of water absorptive property. Further, since the microfine pores are almost uniformly formed across the entire cross-section of the fibers according to this method, there was a problem that the fibers are liable to become fibrils which deteriorates their physical properties.

In order to solve these problems, a hollow fiber has been proposed in which through grooves (microgrooves) or cracks (slits) are formed from the fiber surface to hollow portions thereof. For instance, it has been disclosed in Japanese Unexamined Patent Publication No. 56-169817 that a fiber having an excellent water absorptive property is obtained by treating a sheath-core type composite fiber wherein a nylon covered with a polyester is treated with a solvent for nylon to form cracks which pass through from the fiber surface to hollow portions therein and are formed parallel to the fiber axis. Further, it has been disclosed in Japanese Examined Patent Publication NO. 60-37203 that a water absorptive fiber is obtained by applying a twisting force to composite fibers having the structure mentioned above, and then dissolving off a part of the core portion. Still further, it has been disclosed in Japanese Unexamined Patent Publication No. 5-44160 that a part of the core component in the composite fiber mentioned above is exposed to make the dissolution of the core component easy.

Incidentally, in all of the proposals mentioned above, since sheath-core type fibers in which the polymer in the sheath portion has a weight reduction rate with an alkali different from that of the core portion, such extremely complicated steps in spinning technology, called composite spinning, must be used. In addition, since the difficulty inevitably arises in these methods that the polymer in the core portion cannot completely be removed and that the removal ratio of the polymer in the core portion is dispersed, there have been problems that uneven dyeing occurs and that deterioration of the physical properties and abrasion resistance of the hollow fibers themselves occur, and thus the fibers may not withstand practical use.

DISCLOSURE OF THE INVENTION

An object of the present invention is to overcome such disadvantages as in conventional methods which are caused from the use of polymers having different solubility; that is (1) a problem that spinning steps are complex and production cost increases; (2) a problem that complete removal of the core portion cannot be assured, and uneven dying and quality lowering arises due to the polymer remaining in the core portion; and (3) a problem that the physical properties as a hollow fiber are deteriorated.

Another object of the present invention is to provide a hollow fiber fabric having an improved "scroopy feeling" and water absorptive property and a process for producing the fabric. As still further object of the present invention is to provide a hollow fiber fabric provided with a desired function and a process for producing the fabric.

As a result of diligent study by the present inventors to solve the problems mentioned above, it was discovered that in composite fibers extruded through hollow fiber spinnerets constructed with a plural number of slit orifices, low orientation portions of polymer which are inevitably formed at the time of spinning when the ratio of hollowness becomes higher than 20%, and/or the portions where deformation strain is concentrated by the stress applied at the time of spinning, stretching, or weaving or knitting, are preferentially dissolved off with a solvent or solution for the polymer, and a desired hollow fiber can be obtained without fear of lowering of physical properties of the fiber as a whole, lending to the present invention.

Thus the present invention is aimed at providing a hollow fiber fabric comprising hollow fibers which have a high hollowness ratio of at least 20% and are composed of a polymer of a single composition, the hollow fibers having slits as traces of a removed polymer the slits being formed in the longitudinal direction of the fibers in such a state that the slits communicate with the hollow portions.

Further, the present invention provides a process for producing a hollow fiber fabric comprising the steps of treating a fabric comprising hollow fibers having a high hollowness ratio of at least 20% and composed of a polymer of a single composition with a solvent or solution which dissolve the polymer, to partially dissolve the polymer in low orientation portions and/or deformation strain concentrated portions located in the longitudinal direction of the hollow fibers to form slits as traces of removed polymer in the lengthwise direction of the hollow fibers in such a state that the slits communicate with hollow portions of the hollow fibers.

BEST MODE FOR CARRYING OUT THE INVENTION

The present invention is explained below in detail.

Figure 5:
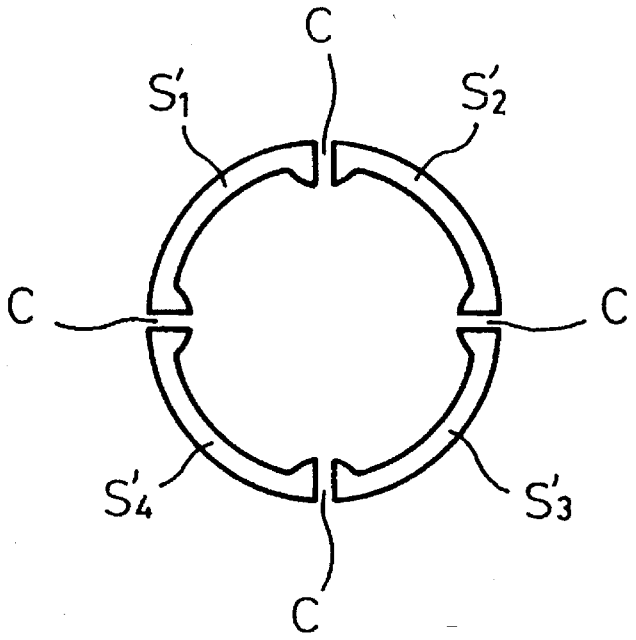
FIG. 5 is a crosssectional view showing an example of a circular nozzle for spinning a hollow fiber.

In the present specification, an explanation is given taking a hollow fiber of a circular crosssection as an example. A hollow fiber is obtained by using a spinning nozzle comprised of an assembly of a pluraling of slit like orifices $S_1'$ to $S_4'$ as shown in FIG. 5. That is, there is a small gap C (called a canal) between edge portions of adjacent orifices, but the polymers extruded from each of the orifices are put together at this portion by the Barus effect to form a hollow fiber.

Figure 1:
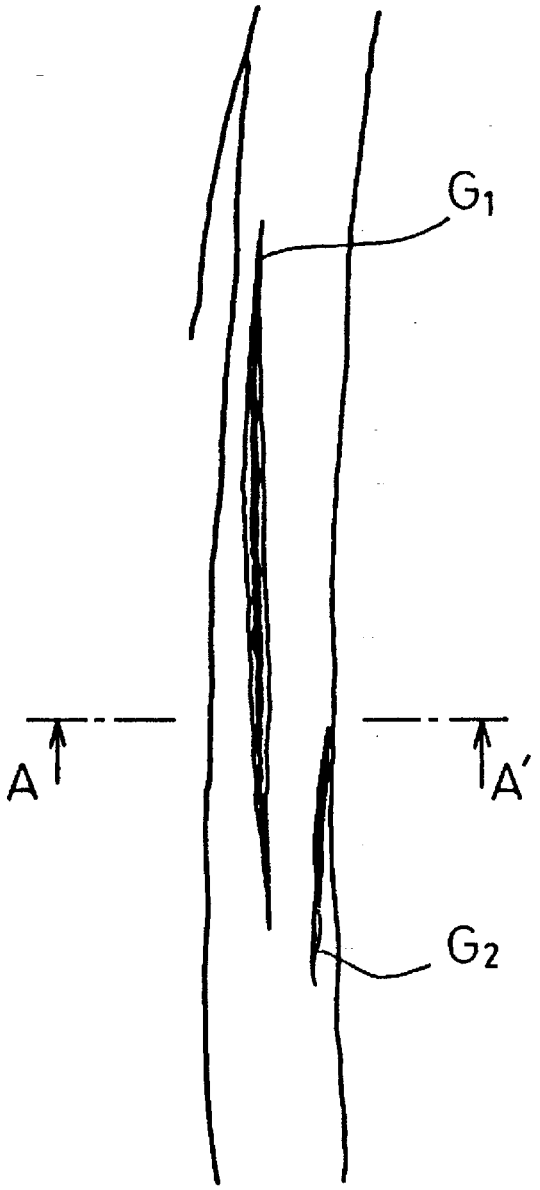
FIG. 1 is a side view of a hollow fiber which constitutes at least a part of the fabric of the present invention, showing the shape of the slits.
Figure 2:
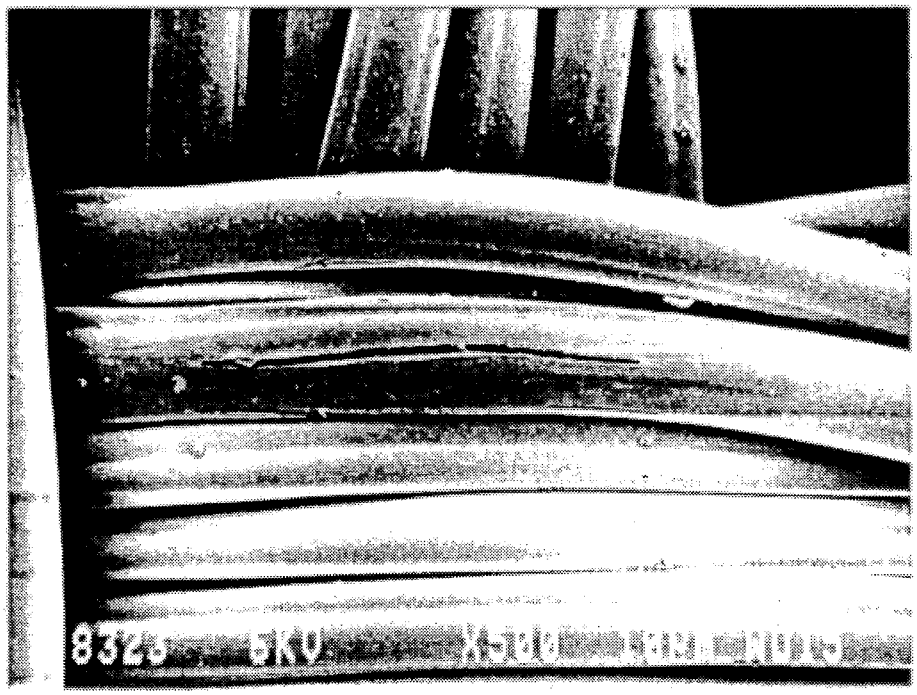
FIG. 2 is an electron micrograph of the side view of such a hollow fiber as shown in FIG. 1.

FIG. 1 demonstrates a side view of a hollow fiber after a fabric comprising a polyester hollow fiber was treated with an alkali, in which $G_1$ to $G_4$ ($G_3$ and $G_4$ are not shown in this side view) show slits extending in the longitudinal direction of the fiber.

Figure 3:
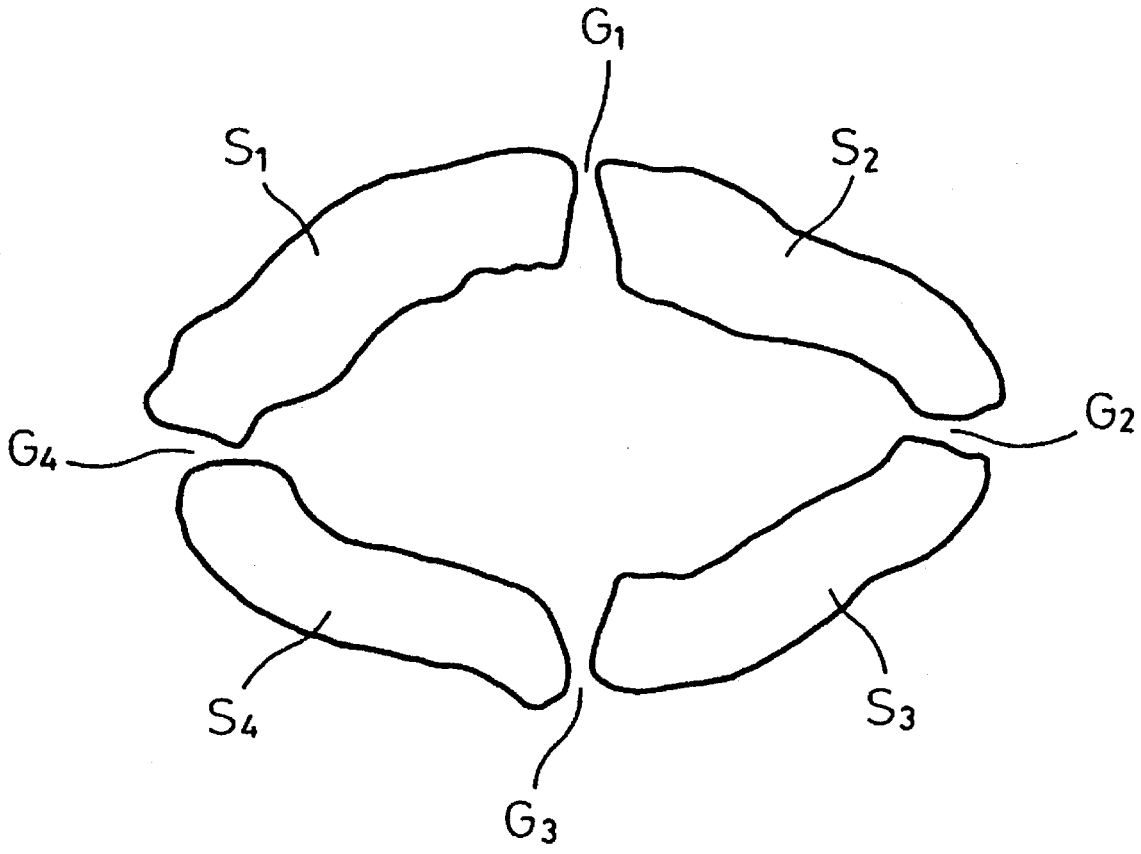
FIG. 3 is a crosssectional view of a hollow which constitutes at least a part of the fabric of the present invention, showing the state wherein four slits extending in the longitudinal direction are in communication with a hollow portion.
Figure 4:
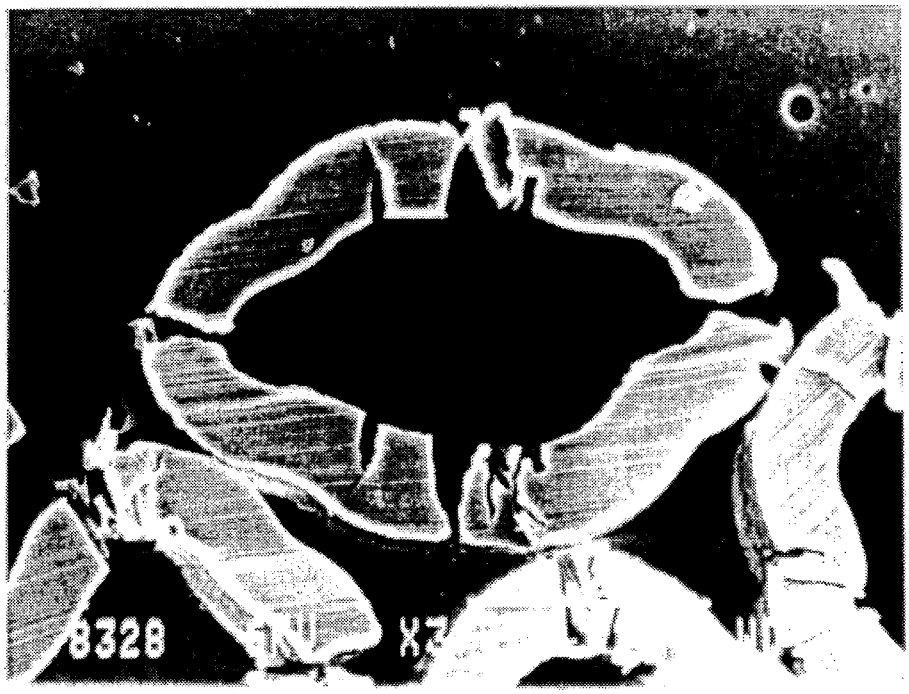
FIG. 4 is an electron micrograph of the cross section of such a hollow fiber as shown in FIG. 3.

Also, FIG. 3 demonstrates the crosssection taken along the line A—A' in FIG. 1. In FIG. 3, $S_1$ to $S_4$ indicate a thin skin portion of a hollow fiber, $G_1$ to $G_4$ indicate a slit extending in the longitudinal direction of a fiber, and this portion is formed by preferentially dissolving off the low orientation and/or deformation strain concentrated portions of the polymer extruded from slit like orifices $S_1$ to $S_4$ shown in FIG. 5 by an alkali treatment.

The "low orientation portion" refers to the portion where the thickness of the thin skin portion became thinner compared with its circumference due to the unevenness of extrusion at the time of polymer extrusion, etc., and the portion where the flow of the polymer did not sufficiently occur and the molecular orientation became lower as compared with other fiber forming portions.

Also, the "deformation strain concentrated portions" means the portion where deformation strain developed due to the stress applied in the direction perpendicular to the fiber axis at the steps of spinning and stretching, or the step of weaving or knitting; specifically it refers to the vicinity of each apex in the case where the cross-section of a hollow fiber is polygonal, or refers to the polymer junction portion where extruded polymers collide with each other due to the Barus effect (corresponding to each of the portions C in FIG. 5). Further, in the vicinity of these low orientation and/or deformation strain concentrated portions, additional slits may be produced in addition to the slits mentioned above.

The polymer used in the present invention is suitable for the production of hollow fibers of a high hollow ratio. The polymer may be a thermoplastic polymer which can be dissolved with a solvent or solution after formed into fibers; and polyester and polyamide can preferably be exemplified. Further, while the hollow fibers are composed of a polymer of a single composition in the present invention, the hollow fibers composed of the polymer of a single composition as used herein means that the hollow fibers do not include composite fibers composed of polymers having two or more compositions, and thus the polymer composition itself may be composed of two or more polymers.

Further, the polymer used in the present invention may be blended with, for example, a modifier, antioxidant, flame retardant, antistat, agent for forming micropores, colorant, stabilizer, and inorganic fine particles as long as the objects of the present invention can be attained. However, when an organic sulfonic acid metal salt proposed in Japanese Examined Patent Publication No. 61-60188 was added, fibrillation occurs, and fiber properties may be deteriorated.

Next, the polymer mentioned above is subjected to melt spinning by a conventional method, taken up at a rate of 1000 to 4000 m/min, and then stretched, if necessary, to obtain hollow fibers having at least a 20% hollowness ratio. Here, "hollowness ratio" means the value expressed by $\{S_2/(S_1+S_2)\}\times100$ when the area of the portions which are filled with a polymer and exist around the hollow portions in the crosssection of hollow fibers is assumed to be $S_1$, and the area of hollow portions at the crosssection is assumed to be $S_2$. The ratio is calculated as an average value of 20 fibers, from photographs of a crosssection of hollow fibers taken at a magnification of 500X. When the hollowness ratio is less than 20%, dissolution of the low orientation and/or deformation strain concentrated portions hardly occurs, and the desired hollow fibers cannot be obtained. The upper limit of the hollowness ratio is suitably at the highest about 70% from the viewpoint of securing physical properties as fiber. The hollowness ratio is preferably in the range of 30 to 50%.

In the stretching mentioned above, extruded fibers may be stretched at a stretching ratio of less than its natural draw ratio (NDR) to form thick-and-thin hollow fibers in which unstretched thick portions and stretched thin portions exist in a mixture. In this case, while it is possible to form slits in both thick portions and thin portions, more slits can be formed in the thick portions than in the thin portions by adjusting the conditions of a chemical treatment for dissolution as suitable since the orientation degree is particularly low in the thick portions. When slits are selectively formed in the thick portions, physical properties of the fiber including abrasion resistance (fibrillation resistance) and others are further improved, since the "scroopy feeling" is more emphasized and a resistance to external stress is increased.

The thick to thin ratio (ratio of diameter of thick portions to that of thin portions) of a filament of the thick and thin hollow fibers mentioned above is preferably less than 1.9. When the thick to thin ratio exceeds 1.9, microgrooves become too large and the fibrillation resistance may be deteriorated.

There is no specific restriction in the cross-sectional shape of the hollow fibers, and shapes such as triangle, plate-shaped, star-shaped, and boomerang-shaped in addition to a circular crosssection can be freely adopted without restraint. In this case, the shape of the hollow portions may be the same as, or different from the peripheral shape of the fiber crosssection.

In the present invention, the hollow fibers mentioned above are subjected to a dissolution treatment (chemical dissolution treatment) with a solvent or solution which dissolves the polymer to form slits in the longitudinal direction of the fibers after the fibers are converted into a fabric by a weaving or knitting or another suitable method.

These slits are formed in the longitudinal direction of the fibers as traces of removed low orientation and/or deformation strain concentrated portions which exist at at least one point on the portions having a thin skin in the crosssection of the hollow fiber; particularly in the case that the fabric is a woven fabric, the slits are formed predominantly at or in the vicinity of the crossing portions of warps with wefts where an excessive stress is applied; and in the case that the fabric is a knitted fabric, the slits are formed at or in the vicinity of knot portions where an excessive stress is applied, both cases leading to communication of the slits down to hollow portions of the fibers.

When made into a fabric, the hollow fibers may be used in the form of a union woven fabric, union knitted fabric, mixed fiber spinning, or combined filament yarn with synthetic fibers, natural fibers such as cotton and wool, regenerated fibers such as rayons, and polyether ester elastic fibers of a block copolymer having a polyethylene terephthalate type polyester as a hard segment and a polyoxybutylene glycol type polyester as a soft segment.

When the hollow fibers have an approximately uniform thickness, the slits mentioned above are formed so that the width thereof is in a range of 0.2 to 10 μm and the length is in a range of 5 to 200 μm. Further, when the hollow fibers are thick and thin fibers, they are formed so that the width is 0.5 to 15 μm and the length is greater than 200 μm, but less than 2000 μm. When the width of the slits is less than 0.2 μm or the length is less than 5 μm, not only can the "scroopy feeling" and water absorptive properties not be obtained but also the impregnation of the agent mentioned below which gives functionality to fibers is difficult to achieve. On the other hand, when the width exceeds 15 μm or the length exceeds 2000 μm, the surface of the fibers is liable to become fibrillose, so that abrasion resistance is reduced, and maintenance of the hollow portions becomes difficult.

In the case, for instance, that the fibers to be used are polyesters, it is proper that the dissolution treatment for forming slits is carried out by the treatment for reducing the weight with an alkali which is conventionally performed, but it is possible to suitably control the frequency of the production of slits by carrying out the alkali treatment so as to rapidly reduce the weight of the fibers as compared with the ordinary alkali treatment for reducing the weight. In this case, it is suitable to make the concentration of an aqueous alkaline solution such as sodium hydroxide and potassium hydroxide 40 to 250 g/l and to carry out the alkali treatment at 80° to 140° C. for 2 to 60 min. For the weight reduction with an alkali, methods which are already known can be used without restraint, for example, suspending weight reduction, cold batch, batch weight reduction with a jet dyeing machine, or continuous weight reduction using steam or super heated vapor.

In the formation of slits, a high pressure dyeing treatment may be performed after the alkali weight reduction mentioned above. The use of a jet dyeing machine in a high pressure dyeing treatment in particular, is preferable since temperature increasing effect and crumpling effect preferably interact synergically.

Further, in the present invention, the fabric may be pressed prior to the dissolution treatment mentioned above. Since strain is concentrated at the low orientation and/or deformation strain concentrated portions existing in the longitudinal direction of the hollow fibers by pressing, and since partial dissolution treatment is accelerated by occurrence of microcracks or the like, the formation of slits tends to become easier. As a preferable method for pressing, a calendar processing using a roll composed of cotton and metal can be mentioned, and a particularly remarkable accelerating effect of dissolution may be exhibited when so-called friction rolls where the speed of upper and lower rolls are different are used. As the roll to be used, those having a flat surface or embossed rolls having engraved patterns are suitably selected depending on the purpose.

Heating temperature is suitably lower than the second order transition temperature of the hollow fibers and when the hollow fibers are composed of polyester, a temperature lower than 50° C. is more preferable. When the pressing temperature exceeds the second order transition point, the polymer which constitutes the hollow fibers becomes easy to flow, and collapse of the hollow portions and deterioration of the physical properties of the fibers are liable to occur. The pressure at this time is preferably 5 to 60 Kg/cm in terms of linear pressure. When the linear pressure is less than 5 Kg/cm, the effect of accelerating partial dissolution treatment is insufficient, while on the other hand, if the linear pressure exceeds 60 Kg/cm, the hollow fibers are flattened, and the gloss of the fabric increases so that the fabric cannot be used.

As methods for pressing other than the calendar processing, a stone wash processing or the like can be mentioned. In these methods, the fibers which constitute the fabric are subjected to pressing partially and at random with solids such as stones.

It is possible to cause an agent, which gives a functionality to fibers, to exist in the hollow portions of the hollow fibers which constitute the fabric obtained by the methods mentioned above through the slits formed at the portions having a thin skin at crosssection. Here, an agent which gives functionality to fibers means a substance which can develop several chemical functionalities when added to the fibers, and the following can be mentioned as examples thereof:

(1) Extracts of plants and plant proteins

One type of substance can be obtained by drying and then grinding an aqueous solution or extract obtained from a plant by extracting with water or an aqueous solution of an alkylene glycol (for example, 45% aqueous solution of propylene glycol).

For example, aloe, root of kudzu (arrowroot), wheat, rice, tea (black tea or green tea) tomato, carrot, dishcloth gourd, ginkgo tree, and clove.

(2) Animal proteins

For example, crab carapace, milk, silk, beer yeast, milk spirit, casein, and bovine blood can be mentioned.

(3) Ceramic fine particles

Fine particles having a single composition comprising metal oxides, carbides, nitrides, or silicides and having an average primary particle diameter of 0.01 to 1 μm, or their mixed fine particles can be mentioned. Examples, include titanium oxide, zinc oxide, colloidal silica, iron oxide, and aluminum oxide.

(4) Compounds having an antibacterial property or deodorizing property

Compounds having a mildew proofing property, antiseptic property, resistance to bacterium, bactericidal property, or property repelling insects, or mites or ticks, or compounds having a deodorizing property, for example, octacarboiron phthalocyanine, dimethyl phthalate, and diethyl phthalate, may be mentioned.

(5) Compounds having an aromatic property

For example, a rush (FC5696) and jasmine (FC5698) produced by Riken Perfume Industry Co., Ltd., may be mentioned.

(6) Compounds having a water absorptive property or moisture absorptive property For example, a copolymer of polyethylene glycol with polyethylene terephthalate, compounds in which a group having a polyalkylene oxide chain is linked to a polyalkylenepolyamine type skelton and which have an HLB of 6.0 to 16.0, and unsaturated vinyl monomers containing carboxyl group or their polymers or their metal salts, may be mentioned.

The metal ions which constitute the metal salts referred to herein include alkali metal ions such as sodium and potassium, alkaline earth metal ions such as calcium and magnesium, transition metal ions such as zinc, iron, nickel, and cobalt, and other ions such as aluminum, titanium, zirconium, copper, and silver; and any metals can be used as long as the object of the present invention can be achieved.

As preferable compounds, for example, water-insoluble polymers prepared by polymerizing a water-soluble monomer represented by the following general formula (I) can be mentioned:

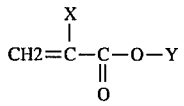

(I)

wherein X represents a hydrogen atom or alkyl group having 1 to 4 carbon atoms and Y represents an organic group having 1 to 80 organic groups.

The water-insoluble polymers mentioned above are particularly preferable, since they can improve the durability of the water absorptive property and moisture absorptive property without impairing original hand feeling of the fabric when they do not exist on the surface of the hollow fibers or void between the fibers, but exist only in the hollow portions of the hollow fibers.

As methods for filling the water-insoluble polymer only in the hollow portions thereof, examples include (i) a method wherein a water-soluble monomer as mentioned above is filled in the hollow portions of the fibers and a polymerization inhibitor such as hydroquinone and hydroquinone monomethyl ether is applied on the surface of the hollow fibers prior to the polymerization in the hollow portions; and (ii) a method wherein a water-soluble monomer is filled in the hollow portions of the fibers, immersed in a hot water bath at 50° to 130° C., preferably 70° to 100° C., the monomer in the hollow portions is polymerized and the water-soluble monomer existing on the surface of the hollow fibers and in voids between the fibers is washed off.

As specific preferable examples of the water-soluble monomers mentioned above, monomers represented by the following formulas (II) to (IV) can be mentioned:

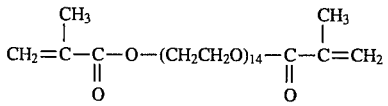

(II)

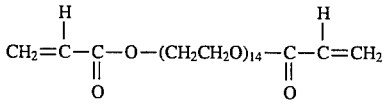

(III)

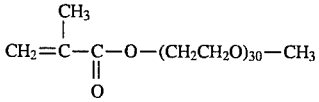

(IV)

(7) Compounds having a water repellency

For example, fluorine containing polymers which have a fluorocarbon group such as perfluoroalkyl represented by the following formula at its side chain and have a polyacrylic acid ester or methacrylic acid ester type polymer at its main chain, and silicone type resin such as dimethylpolysiloxane or its copolymer:

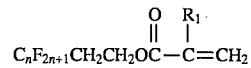

wherein $R_1$ represents hydrogen or methyl group, and n is an integer of 3 to 21, can be mentioned.

(8) Others

Cellulose, chitin, chitosan, alginic acid, and others can be mentioned.

As the method for filling an agent which gives a functionality to the fibers (hereinafter referred to as fiber functionalizing agent for convenience) in the hollow portions of the hollow fibers through slits, methods preferably include (i) a method in which the hollow portions are filled by substituting air with a solution or dispersion (including an emulsion) containing a fiber functionalizing agent, or a liquid such as a liquid state fiber functonalizing agent by allowing elastic recovery after a pressure within an elastic limit is applied to the hollow fibers, and (ii) a method in which air is removed by placing a hollow fiber fabric in a closed vessel and reducing pressure, and then injecting a fiber functionalizing agent. The medium used in these solution or dispersion (including an emulsion) is preferably a mixed solvent in which water and less than 20% by weight of an organic solvent are mixed.

The pressure within an elastic limit refers to an approximate pressure under which collapsing of the hollow portions in the hollow fibers or deterioration of the physical properties of fibers does not substantially occur, and this pressure is determined based on the composition, shape, and hollowness ratio of the hollow fibers to be used.

Figure 6:
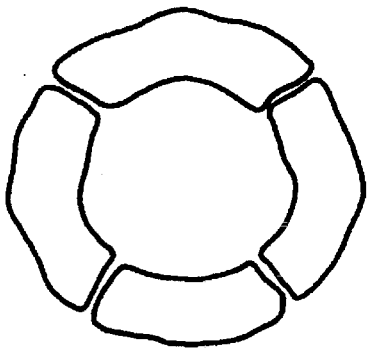
FIG. 6 is a diagram showing an example of a crosssection of a hollow fiber after pressure was applied.
Figure 7:
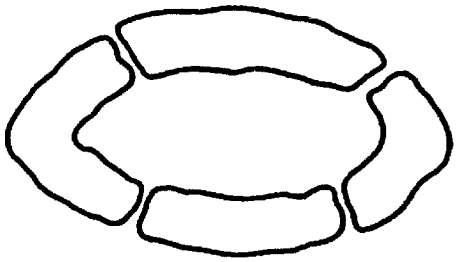
FIG. 7 is a diagram showing a crosssection of a hollow fiber after the pressure was eliminated and the elasticity was recovered.

Usually, when the pressure as described above is applied, in the hollow fibers having such a shape as shown in FIG. 6, the inside of the hollow portions contact each other as shown in FIG. 7 or become similar to the shape shown in FIG. 7, and the fibers elastically recover to their original hollow shape (FIG. 6) after the pressure is removed. In this case, a liquid containing a fiber functionalizing agent is absorbed and fills, the hollow portions of the fibers as the fibers resume their original shape after the pressure is removed. The temperature during the pressurization is preferably lower than 100° C. The time in which the pressure is applied is desirably less than 10 seconds and more preferably less than 2 seconds. If the time is greater than 10 seconds, not only is the time needed for the restoration is prolonged, but also destruction of the hollow portions may occur when the pressure is applied.

Pressurization is preferably carried out in a liquid containing a fiber functionalizing agent, but the hollow fibers may be immersed in a liquid after pressure is applied since from a few seconds to about one minute is required for the hollow portions to elastically recover their original state. As the means for applying pressure, a method in which the fibers are pressed or squeezed with a roll and a method in which the fibers are scraped with an edge such as of a knife can be used.

When heat, vibration, or an action of crumpling are applied at the same time, the hollow portions are filled more quickly. Here, heating refers to heating a liquid containing a fiber functionalizing agent to a temperature of from room temperature to 100° C. When the temperature becomes high, the viscosity of the solution is reduced and passage through the slits becomes easy. Vibration means that the fibers or fabric is directly vibrated, or that the solution around the fabric is vibrated. For example, a vibrator, ultrasonic waves, or blowing a solution from a nozzle can be applied. A particularly preferable method is one in which a solution is blown from an orifice of a pipe installed in a liquid against the fibers or fabric. In this case, the diameter of the orifice is preferably less than 2 mm.

After a liquid containing a fiber functionalizing agent is filled in the hollow portions by one of the methods mentioned above, the liquid medium containing the fiber functionalizing agent is removed by a heat treatment or another means, dried, and cured to fix the fiber functionalizing agent in the hollow portions.

As already explained, the present invention was completed by observing low orientation and/or deformation strain concentrated portions existing in the hollow fibers, based on the knowledge that, in the hollow fibers having a hollow ratio of not lower than 20% an extremely high chemical weight reduction property is exhibited at low orientation and/or deformation strain concentrated portions, while the hollow fibers are composed of a polymer of the same composition.

FIG. 5 shows the crosssection of a nozzle for spinning a hollow fiber (here, a circular crosssection), and these nozzles for spinning hollow fibers are essentially composed of a plurality of slit-like orifices (here, four orifices). When a polymer is extruded from each of the slit-like orifices ($S'_1$ to $S'_4$), usually a slight difference in the rate of extrusion inevitably occurs, this difference is amplified by the unevenness in cooling after extrusion, and low orientation portions come to exist along the longitudinal direction of the fiber at portions of the hollow fiber having a thin skin. By subjecting such hollow fibers to a chemical weight reduction treatment, for instance, subjecting hollow fibers composed of a polyester to an alkali treatment, slits extending in the longitudinal direction of the fiber are formed as shown in FIG. 1. When thick-and-thin fibers having thick portions and thin portions are used as hollow fibers, it is possible to optionally adjust the frequency of slit formation by suitably adjusting the hollowness ratio and thick-to-thin ratio of the thick portions and thin portions, respectively.

Further, it has also been found that the slits mentioned above are remarkably formed when chemical weight reduction treatment is carried out at the portions where hollow fibers are most subjected to strain, that is, the crossing portions of warps with wefts or in the vicinity thereof in woven fabrics, or knotted portions of hollow fibers in the vicinity thereof in knitted fabrics, because hollow fibers are subjected to strain in the direction perpendicular to the fiber axis at the steps of spinning and stretching, and thus are formed predominantly at the portions where deformation strain is concentrated or hollow fibers are pressed after being converted into a fabric. When considering the facts that the fabric portions which contact human beings are mainly the warps-wefts crossing portions or knot portions, this means that hand feeling and water absorptive property are remarkably improved, and fabrics which afford a refreshing feeling can be provided. As a matter of course, additional values of the fabrics can further be increased by introducing a desired fiber functionalizing agent through the slits.

The present invention is explained next with reference to the following Examples, but the present invention is not restricted by these Examples.

In the following Examples, the formation frequency of slits, width and length of the slits, hand feeling, water absorption ratio, and abrasion resistance were determined by the following methods:

(1) Formation frequency of slits

The formation frequency was obtained by the observation of a photograph of the surface of the fiber taken at a magnification of 750 to 1500 by using a scanning type electron microscope.

The formation frequency of slits was calculated by counting the number of the filaments in which slits are formed, at or in the vicinity of the crossing portions of the warps with wefts in the case of a woven fabric, or at or in the vicinity of knot portions in the case of knitted fabric, in 100 filaments, and calculating by using the following equation:

Formation frequency (%)={(number of the filaments in which slits are formed)/100}×100

(2) Width and length of slits

These were obtained from the observation of a photograph of the surface of the fiber taken at a magnification of 3000 by using a scanning type electron microscope Measurements were performed for at least 20 filaments and the average value was obtained.

(3) Hand feeling (scroopy feeling)

Scroopy feeling caused by the slits was evaluated with feeling rated in four grades: excellent, good, fair, and poor.

(4) Water absorptive property (wicking property)

According to JIS L1079-66, 1018-70, a drop of water is dropped from the tip of a burette on a sample, the time (seconds) when the mirror reflection by the water drop come to unnoticeable is determined. Accordingly, the smaller the value, the better the water absorptive property means.

(5) Abrasion resistance

Using a Georgette composed of 100% polyethylene terephthalate fibers as a rubbing cloth, a sample cloth is subjected to 200 times of surface abrasion under a load of 500 g with a Gakushin type surface abrasion tester for the test of rubbing fastness, and the degree of development of discoloration is determined with a gray scale for color change. The case where the abrasion resistance (fibrillation resistance) is extremely low is assumed to be rate 1, and the case where it is extremely high is assumed to be rate 5. For practical use, a rate 4 or greater is preferable.

Example 1

A polyethylene terephthalate containing 0.3% by weight of titanium oxide and having an intrinsic viscosity of 0.61 was melted, extruded from a nozzle for hollow fiber spinning shown in FIG. 5, and wound up at a rate of 1400 m/min. The amount of the polymer to be extruded was adjusted such that the total denier after stretching and heat treatment was 50 denier. The natural drawing ratio of the unstretched filaments thus obtained was 2.1 times, and the filaments were stretched between a supplying roll heated to 60° C. and a stretching roll at a stretching ratio shown in Table 1 below, and consecutively subjected to a heat treatment with a noncontact heater at 180° C. to obtain multi-filament yarns having a 35% hollowness ratio and a circular crosssection, and to obtain thick-and-thin hollow multi-filament yarns (50 denier/20 filaments) having a hollowness ratio of 35% at the thick portions and a circular crosssection.

Plain weave fabrics were prepared from each of the multi-filament yarns by a conventional method, and subjected to a scouring treatment and a pre-set. The fabrics thus obtained were treated in a hot water (at 105° C.) containing 50 g/l of sodium hydroxide for 10 min to reduce the weight by 15%, and then subjected to dyeing under the following conditions:

| Conditions | |
|---|---|
| Sumikalon Navy Blue S-2GL (produced by Sumitomo Chemical Company, Limited) | 4% o.w.f. |
| $CH_3COOH$ | 0.3 g/l |
| Disper VG (produced by Meisei Chemical Industry, Co., Ltd.) | 0.5 g/l |

After being subjected to dyeing at 130° C. for 60 min, the fabrics were dried at 100° C. for 5 min.

The moisture absorptive property, abrasion resistance, and hand feeling were evaluated for each of the fabrics obtained.

Further, multi-filament yarns were taken out of each of the sample fabrics, and their surfaces were observed through an electron microscope to determine the formation frequency of the slits, and width and length of the slits. The thick to thin ratio and the length of the thick portions and thin portions were also determined for thick-and-thin yarn.

The results are as shown in Tables 1 and 2 below; large slits were formed in the hollow fibers in the fabrics; and the fabrics exhibited a good scroopy feeling, and a high water absorptive property and abrasion resistance.

Particularly in the case where the hollow fibers were thick-and-thin fibers (Experiment Nos. 2 to 5), good fibers were obtained when the thick to thin ratio of filamentary diameter was less than 1.9 (Experiment Nos. 2 to 4).

TABLE 1

| Experiment No. | Stretching ratio | Thick to thin ratio | Size of slits (μm) Width | Length |
|---|---|---|---|---|
| 1 | 2.244 | 1.0 | 0.5–5.0 | 10–50 |
| 2 | 1.933 | 1.12 | 2.0–9.0 | 200–800 |
| 3 | 1.604 | 1.65 | 5.0–12.5 | 250–1300 |
| 4 | 1.311 | 1.80 | 10.0–15.0 | 300–1800 |
| 5 | 1.200 | 2.0 | 12.5–18.0 | 400–2000 |

TABLE 2

| Experiment No. | Formation frequency (%) | Water absorptive property (second) | Abrasion resistance (rate) | Hand feeling |
|---|---|---|---|---|
| 1 | 26 | 4.1 | 3 | Good |
| 2 | 28 | 2.1 | 5 | Excellent |
| 3 | 31 | 2.4 | 5 | Excellent |
| 4 | 35 | 2.6 | 4 | Excellent |
| 5 | 40 | 2.8 | 3–4 | Excellent |

The density of the plain weave fabrics mentioned above was warps 100 filaments/inch and wefts 80 filaments/inch, and thus the number of intersections was 8000/in$^2$.

Example 2

In Experiment No. 3 in Example 1, the hollowness ratio in the thick portions of the thick-and-thin hollow fibers was changed as shown in Table 3 below.

The results are as shown in Table 3; when the hollowness ratio was less than 20% (Experiment No. 6), sufficient slits were not formed, scroopy feeling was poor, and a sufficient water absorptive property was not obtained. Further, when the hollowness ratio became too large, the tendency of abrasion resistance to decrease was noticed.

TABLE 3

| Ex. No. | Hollowness ratio (%) | Formation frequency (%) | Size of microgrooves (μm) Width | Length | Water absorptive property (seconds) | Abrasion resistance (rate) | Hand Feeling | Remarks |
|---|---|---|---|---|---|---|---|---|
| 6 | 15 | 0 | 1.0–6.0 | 50–100 | >3 min | 5 | Poor | Comp. |
| 7 | 20 | 12 | 1.5–8.0 | 200–450 | 3.2 | 5 | Good | In. |
| 8 | 30 | 24 | 2.0–8.5 | 200–700 | 3.0 | 5 | Exc. | Inv. |
| 9 | 40 | 51 | 4.5–12.5 | 220–900 | 2.3 | 5 | Exc. | Inv. |
| 10 | 50 | 81 | 6.5–13.5 | 270–1500 | 2.1 | 4 | Exc. | Inv. |
| 11 | 60 | 98 | 11.5–17.0 | 350–1900 | 2.0 | 3–4 | Exc. | Inv. |

Note: The abbreviations "Inv." and "Exc. in Table 3 mean "The present invention" and "Excellent", respectively.

Example 3

A polyethylene terephthalate containing 2.5% by weight of titanium oxide and having an intrinsic viscosity of 0.61 was melted, extruded from a spinneret having 20 nozzles for hollow fiber spinning, and then subjected to a stretching and heat treatment to obtain multi-filament yarns of 50 denier/15 filaments having a hollowness ratio of 38%.

Using this multi-filament yarn, a plain weave fabric was prepared according to a conventional method, and subjected to scouring, relaxing, drying, and presetting.

Subsequently, the fabric mentioned above was subjected to a pressing treatment under conditions of a temperature of 40° C., linear pressure of 50 Kg/cm, and at a rate of 10 m/min by using a calendaring device having a mirror surface roll and paper roll.

Then, this fabric was subjected to a boiling treatment in an aqueous sodium hydroxide solution of a concentration of 40 g/l for 60 min, to reduce its weight by 20%, and then dyed using the same method as in Example 1.

Multi-filament yarns were taken out of the fabric obtained, its surface was observed by an electron microscope to observe slits having a width of 0.2 to 2.0 μm and length of 10 to 150 μm, at a frequency of 65%. Further, this fabric showed a scroopy feeling corresponding to the rate "Excellent", water absorption which was 2.0 seconds and abrasion resistance of grade 4.

Example 4

The fabric obtained in Example 3 was subjected, without being pressed, to a boiling treatment in an aqueous sodium hydroxide solution of a concentration of 50 g/l for 20 min, to reduce its weight by 20%, and then dyed in the same method as in Example 1.

Multi-filament yarns were taken out of the fabric obtained, its surface was observed with an electron microscope to observe the slits having a width of 0.5 to 5.0 μm and length of 40 to 120 μm, at a frequency of 49%.

Then, this fabric was immersed in 10% aqueous solution of a mixture of sodium pyrrolidonecarboxylic acid with monoundecylacyl glycerol as fiber functionalizing agent (Tendre DC-87, produced by Daiwa Chemical Industry Co., Ltd.) at 90° C. for 1 min.

The pick up ratio when this fabric was taken out from the solution was 98%. Then, this fabric was washed with water at an ambient temperature for 5 min to separate the fiber functionalizing agent stuck to the gaps between the fibers, dried at 100° C. for 5 min, and then subjected to a curing at 160° C. for 1 min.

The fabric was observed through a transmission type optical microscope (produced by OLYMPUS OPTICAL COMPANY LIMITED) to confirm that solid Tendre DC-87 was sufficiently filled in the hollow portions of the component fibers.

The fabric had a soft and clammy feeling, and had an excellent moisture absorption ratio and antistatic property in addition to a high water absorptive property as shown in Table 4 below.

Further, this hand feeling, water absorptive property, and moisture absorptive ratio were scarcely changed even after 20 times of washing.

Comparative Example 1

Example 4 was repeated except that polyethylene terephthalate multi-filament yarns having a 15% hollowness ratio were used.

Multi-filament yarns were taken out of the fabric obtained, and their surface were observed through an electron microscope, but almost no slits were observed (formation frequency 5%).

Further, the fabric obtained was observed through a transmission type optical microscope (produced by OLYMPUS OPTICAL COMPANY LIMITED) to find that solid Tendre DC-87 was only slightly filled in the hollow portions of component fibers.

This fabric was excellent in an initial water absorptive property, moisture absorption ratio, and antistatic property as shown in Table 4, but the properties were deteriorated by washing and the fabric was undurable.

TABLE 4

| | | Water absorptive property (second) | Moisture absorption ratio (%) | Antistatic property (V) |
|---|---|---|---|---|
| Example 4 | Before washing | 1.0 | 7.5 | 4 |
| | Washing 5 times | 0.5 | 3.6 | 60 |
| | Washing 20 times | 0.5 | 3.2 | 160 |
| Comparative Example 1 | Before washing | 1.0 | 0.5 | 100 |
| | Washing 5 times | more than 3 min | 0.6 | 3800 |
| | Washing 20 times | more than 3 min | 0.5 | 4200 |

In Table 4, moisture absorption ratio and antistatic property were determined by the following methods. Further, washings were carried out according to the method of JIS L-1018-77 6.36 H, and repeated 20 times at most.

(6) Moisture absorption ratio

After a test cloth was preliminarily dried at 50° C. for 2 hours, it was dried at 105° C. for 2 hours. The weight at this time was determined and assumed to be $W_0$. Then, the test cloth was placed in a desiccator at 20° C., 90% RH for 72 hours; its weight was determined and assumed to be $W_1$; and moisture absorption ratio was calculated by the following equation:

$$\text{Moisture absorption ratio (\%)}=\{(W_1-W_0)/W_0\}\times 100$$

(7) Antistatic property (Frictional electrification voltage)

Using a rotary static tester (Kyoto University, Chemical Research Institute type), a sample and a cotton broadcloth were subjected to rubbing under the following conditions, and numerical values of the recorder were read after 1 minute. The smaller the value, the better the antistatic property.

| Conditions | |
|---|---|
| Drum revolution speed | 700 rpm |
| Electrification equilibrium time | 1 min |
| Contact pressure load | 600 g |
| Measuring atmosphere | 20° C., 40% RH |

Example 5

Example 4 was repeated except that a dispersion of an organic acid ester (produced by Daiwa Chemical Industry Co., Ltd., Tradename: *Anincene* CBT) which is a mite proof agent was used instead of a mixture of sodium pyrrolidonecarboxylic acid with monoundecylacyl glycerol.

The pick up ratio when this fabric was taken out from the solution was 55%.

The mite proof agent existed in the hollow portions in the fibers of the fabric obtained, it exhibited a soft feeling and a high mite proof property (Repellent ratio of Dermatophagoides pteronyssinus 92.8%).

A mite proof test was carried out by the following method:

(8) Method for testing mite proof property

A plastic Petri dish having a diameter of 4 cm and a height of 0.6 cm was placed on an adhesive sheet, and around the dish, six more of the same type Petri dishes were placed such that the 6 dishes all made contact with the central Petri dish.

In the central Petri dish, a mite medium of about 3000 in terms of the number of living mites was introduced; in the six Petri dishes placed around the central Petri dish wherein the mites were introduced, samples of treated regions and untreated regions were alternatively placed; on each of the samples, 0.05 g of powder feed containing no mites was placed. This was introduced into a plastic vessel of 27×13×9 cm, together with the adhesive sheet, a saturated salt water was introduced, covered up; the humidity in the vessel was maintained about 75%; introduced in an incubator at 26° C.±1° C. to bleed for a whole day and night.

The next day, mites were collected by using a saturated salt water floating method for the powder feed on the sample and by a washing method for the sample, respectively, counted, and then the repellent ratio was calculated by applying the following equation. Considering the dispersion, tests were repeated 3 times. As the mites, Dermatophagoides Pteronyssinus was used.

Repellent ratio (%)={1-(number of mites at treated region/number of mites at control region)}×100

INDUSTRIAL APPLICABILITY

The present invention can be advantageously employed in industry since it can provide a fabric composed of hollow fibers excellent in scroopy feeling and water absorptive property, and endowed with a desired functionality, as well as a method for producing the fabric.

We claim:

1. A hollow fiber fabric comprising hollow fibers which have an approximately uniform thickness, a high hollowness ratio of at least 20% and are composed of a polymer of a single composition, the hollow fibers having slits as traces of removed low orientation and/or deformation strain concentrated portions, along the longitudinal direction of the hollow fibers, said slits being 0.2 to 10 μm in width and 5 to 200 μm in length and in such a state that the slits communicate to the hollow portions.

2. A hollow fiber fabric comprising hollow fibers having thick portions and thin portions, a high hollowness ratio of at least 20% and are composed of a polymer of a single composition, the hollow fibers having slits as traces of removed low orientation and/or deformation strain concentrated portions, along the longitudinal direction of the hollow fibers, said, slits being 0.5 to 15 μm in width and greater than 200 μm, but less than 2000 μm in length and in such a state that the slits communicate to the hollow portions.

3. The fabric according to claim 2 wherein the fabric is a woven fabric and the slits are located mainly at or in the vicinity of the crossing portions of warps with wefts.

4. The fabric according to claim 2 wherein the fabric is a knitted fabric, and the slits are located mainly at or in the vicinity of knot portions.

5. The fabric according to claim 2 wherein an agent, which gives a functionality to the fibers, exists in the hollow portions of the hollow fibers.

6. A process for producing a hollow fiber fabric comprising treating a fabric comprising hollow fibers having a high hollowness ratio of at least 20% and composed of a polymer of a single composition with a solvent or solution which dissolves the polymer, to partially dissolve the polymer in low orientation and/or deformation strain concentrated portions located in the longitudinal direction of the hollow fibers to form slits as traces of a removed polymer in the longitudinal direction of the hollow fibers in such a state that the slits communicate to hollow portions of the hollow fibers.

7. The process according to claim 6 wherein the fabric comprising the hollow fibers is subjected to pressing at a temperature lower than the second order transition temperature of the hollow fibers prior to the treatment with the solvent or solution.

8. The process according to claim 6 wherein the process involves a step wherein an agent which gives a functionality to the fibers is absorbed through the slits.

9. The process according to claim 8 wherein the hollow fibers are subjected to a pressing at a pressure within an elastic limit to the direction rectangularly crossing the longitudinal direction of the fibers, allowing the recovery of elasticity, and simultaneously causing the fibers to absorb a solution or dispersion, or to absorb a chemically functional substance in a fluid state to the hollow portions taking advantage of negative pressure generated with the elastic recovery.

* * * * *